United States Patent [19]

Breed et al.

[11] 4,018,164

[45] Apr. 19, 1977

[54] PROJECTILE FUZE CONTAINING A FLOATING BODY

[75] Inventors: David S. Breed, Boonton; Torbjorn Thuen, Roseland; Allen K. Breed, Boonton, all of N.J.

[73] Assignee: Breed Corporation, Fairfield, N.J.

[22] Filed: June 12, 1975

[21] Appl. No.: 586,434

Related U.S. Application Data

[63] Continuation of Ser. No. 395,962, Sept. 10, 1973, abandoned.

[52] U.S. Cl. ..... 102/78; 102/76 R

[51] Int. Cl.[2] ..... F42C 15/24

[58] Field of Search ..... 102/70.2 R, 76, 78, 102/79, 80, 81, 82, 71, 72

[56] References Cited

UNITED STATES PATENTS

| | | | |
|---|---|---|---|
| 419,143 | 1/1890 | Driggs | 102/79 |
| 2,357,759 | 9/1944 | Nichols | 102/79 X |
| 2,420,028 | 5/1947 | Bleakney et al. | 102/70.2 R X |
| 2,741,184 | 4/1956 | Deringer | 102/71 X |
| 2,754,759 | 7/1956 | Baker et al. | 102/71 |
| 3,397,640 | 8/1968 | Zumba et al. | 102/81 X |
| 3,425,354 | 2/1969 | Carlson | 102/79 |
| 3,621,782 | 11/1971 | Biggar | 102/79 |
| 3,750,589 | 8/1973 | Egli et al. | 102/79 |

*Primary Examiner*—Harold Tudor

[57] ABSTRACT

The projectile fuze of this invention comprises a housing having a cavity which is substantially filled with a liquid. A body having an average specific gravity less than that of the fluid is accommodated in the cavity and is movable forwardly by buoyant forces which arise during projectile launch.

15 Claims, 5 Drawing Figures

PROJECTILE FUZE CONTAINING A FLOATING BODY

This is a continuation, of application Serial No. 395,962, filed in the U.S. Patent Office on Sept. 10, 1973, now abandoned.

Most fuzing mechanisms contain one or more masses which move rearwardly when the projectile is launched and in so doing accomplish some function such as initiation of the arming delay or a cocking or initiation of a self-destruct system. In most cases, substantial fuze simplification would result if these masses could be caused to move forwardly in the fuze rather than rearwardly. These simplifications are primarily evident in the design of the explosive train from the sensitive detonator or primer to the main charge of the projectile.

The forward motion of the body is accomplished in this invention by filling the entire fuze with a fluid and placing within the fuze a body whose average specific gravity is less than that of the fluid. This body is then biased toward the rear of the projectile. When the projectile is launched, the launching acceleration acting on the fluid increases the buoyant forces acting on the less dense body. Under a proper launch condition, these buoyant forces become greater than the biasing forces causing the body to move forwardly in the fuze cavity. The forward motion can be utilized to initiate the safety and arming delay time delay, to initiate a pyrotechnic self-destruct system, or to set up a spin decay selfdestruct system. When this system is used in a 20MM fuze, for example, there results a fuze costing less than one half the cost of other more complex fuzes having similar performance characteristics.

Fuzes constructed according to the invention have application to all projectiles, including 20 – 40 MM gun ammunition, artillery, mortars, projected grenades, and rockets.

One of the primary objects of this invention is to provide a means by which a body within a fuze housing can be made to move forwardly when the projectile is launched as opposed to rearwardly which is customary in other fuzes.

Another object of this invention is to provide a simpler fuzing mechanism for fuzes employing a launch sensing mass.

A further object of this invention is to provide for a simple mechanism for initiating a pyrotechnic selfdestruct system.

Other objects and advantages of this invention will become apparent as the description progresses.

In the accompanying drawings in which two of various embodiments of the present invention are illustrated, FIG. 1 is a cross-sectional view of a safety and arming delay, self-destruct fuze applicable to 20 – 30 MM projectiles and shown in the safe position;

Figure 4:
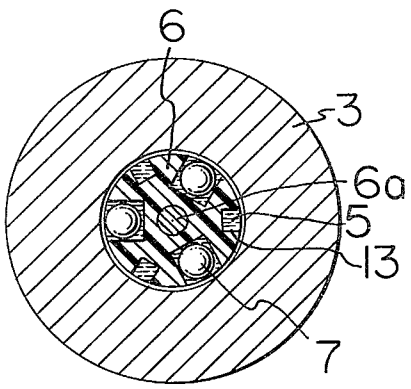
FIG. 4 is a cross-sectional view taken on the line 4—4 of FIG. 1.
Figure 3:
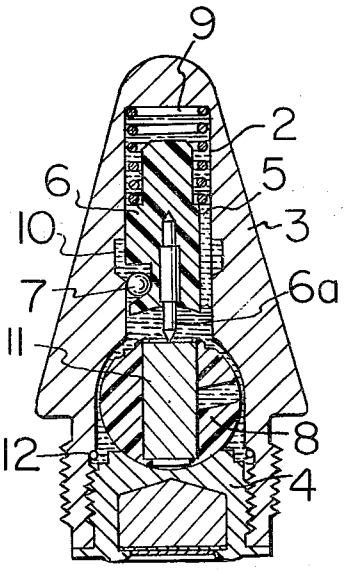
FIG. 3 is the fuze shown in FIG. 1 but illustrating the self-destruct position.
Figure 2:
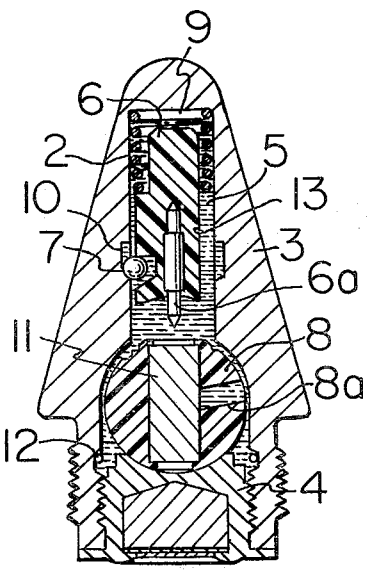
FIG. 2 is the same fuze shown in FIG. 1 but illustrating the armed position.

A fuze constructed in accordance with the embodiment of the invention disclosed in FIGS. 1 - 4 is designated generally by the reference character 1 and comprises a fuze housing 3 within which is a cavity 2. A pyrotechnic booster assembly 4 occupies the rearward end of the cavity 2. The cavity also contains a liquid 5, a body 6 containing a firing pin 6*a*, three detent balls 7, an arming device or ball rotor assembly 8, and a firing pin biasing spring 9. An annular recess or groove 10 is formed in the wall of the cavity 2 and the rear wall of the groove is inclined inwardly and rearwardly. The housing is hermetically sealed.

Figure 1:
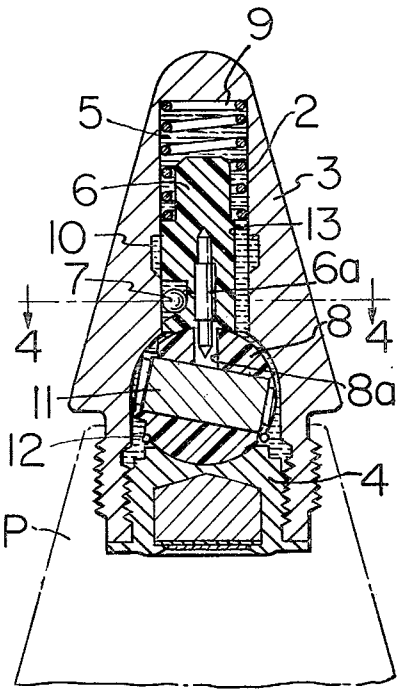

The ball rotor 8 is of known construction and contains a diametrally oriented detonator 11 which, in the position of the fuze shown in FIG. 1, is maintained in a safe position out of alignment with the firing pin 6*a* by a spin detent ring 12, as is conventional, and by the firing pin 6*a* which is accommodated in a bore 8*a* in the rotor.

The body 6 also includes one or more axial grooves 13 forming fluid passages by means of which liquid may pass from either end of the cavity 2 to the other. The number and cross-sectional area of such grooves may vary for a purpose subsequently to be explained. The groove or grooves 13 could be formed in the wall of the cavity 2, rather than in the body 6.

The average density of the body 6, the firing pin 6a, and the balls 7 in combination is less than that of the liquid 5 which substantially fills the cavity 2. Thus, if the fuze were placed in a vertical position, the body 6 and the firing pin 6a would tend to rise in the cavity 2. Such movement is prevented, however, by the force exerted by the biasing spring 9.

The fuze is adapted to be fitted to the nose of a projectile P in a conventional manner so that, when the projectile is fired or launched, substantial acceleration forces act on all parts of the fuze, including the liquid 5, tending to force the liquid rearwardly via the grooves 13 and increasing the net buoyant force acting on the body 6. At the launch, the net buoyant force acting on the body 6 increases until it exceeds the force exerted by the spring 9. The body 6, together with the firing pin 6a, thus moves toward the nose of the fuze until such time as the detent balls are in a position opposite the groove 10. In this position of the body 6 of the firing pin is withdrawn from the bore 8a thereby enabling movement of the rotor 8 from its safe position to an armed position.

The launching of a projectile conventionally imparts spin or rotation to the projectile. A combination of the launching acceleration and centrifugal forces due to projectile rotation enables the detent balls 7 to move into the recess 10. The centrifugal forces also act on the detent ring 12 of the ball rotor 8 to disassociate the ring from the ball rotor and enable the latter to rotate from the safe position shown in FIG. 1 to the armed position shown in FIG. 2 in which the firing pin 6a is aligned with the detonator 11.

When the launching acceleration terminates, the body 6 again is urged toward the ball rotor 8 by the biasing spring 9, but it is latched against movement more than a short distance by the balls 7 which are seated in the recess 10 by centrifugal forces. As the projectile travels through the atmosphere, aerodynamic drag gradually reduces the rotational velocity of the projectile. This in turn reduces the centrifugal forces acting on the balls 7. When the centrifugal forces acting on the balls 7 no longer are sufficient to overcome the force of the biasing spring 9, the balls 7 are forced to move radially inwardly, thereby releasing the body 6 which, under the force of the spring 9, propels the firing pin 6a into the detonator to effect self-destruction of the fuze and its projectile.

The forward motion of the body 6 to a position in which the firing pin 6*a* is withdrawn from the bore 8*a* of the ball rotor 8 is delayed to some extent by the requirement that the liquid initially existing in the space forwardly of the body traverse the grooves 13 so as to occupy an ever-increasing volume rearwardly of the body 6 as the latter moves forwardly. By selection of the number and cross-sectional area of the grooves 13, the resistance to the flow of the liquid, and hence the time delay between the safe and armed conditions of the fuze, can be controlled. The time delay also enables the fuze to sense the difference between a true launch of the projectile and those acceleration forces which would be experienced if the projectile were dropped accidentally.

If the projectile strikes a target at a low graze angle it will decelerate, and such deceleration will cause the liquid 5 to rush forwardly of the fuze cavity so as to exert a net buoyant force on the firing pin body 6 which augments the force exerted by the spring 9. Under such conditions, the combined deceleration and spring biasing forces effect withdrawal of the balls 7 from the recess 10, thereby releasing the body 6 and enabling the firing pin to be propelled into the detonator. In this manner, the fuze destructs after grazing a target.

The fuze mechanism disclosed in FIG. 1 – 4 is a simple structure embodying a minimum of parts, but nevertheless it provides an arming delay as well as selfdestruct and graze-destruct capabilities. In each instance the desired result is obtained by the use of a mass which is caused to move in a direction opposite the effective direction of the acceleration forces acting on the projectile. The essential characteristic of the fuze is that the movable parts of the fuze be immersed in a fluid which has a greater density than that of the movable parts.

Figure 5:
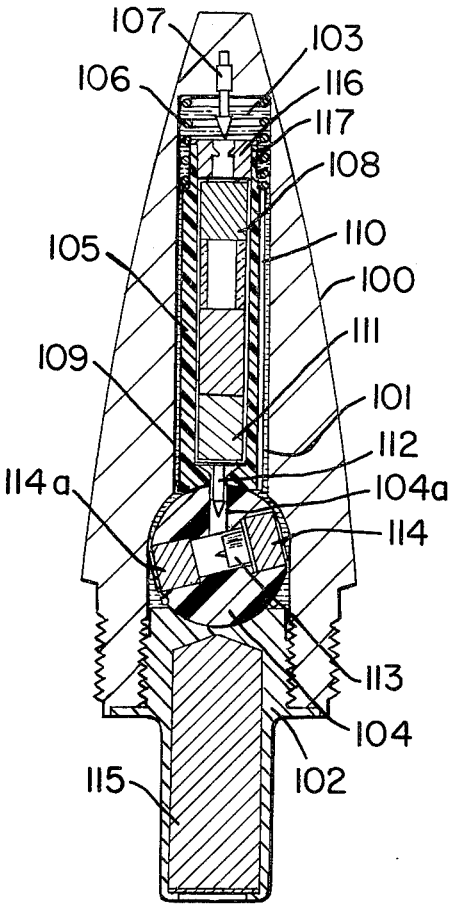
FIG. 5 is a partial cross-section view of a 35 MM fuze containing a pyrotechnic self-destruct system.

The embodiment shown in FIG. 5 is especially adapted for use in 35 MM ammunition and comprises a hermetically sealed fuze housing having a cavity 101 therein occupied at its rearward end by a booster assembly 102. The cavity contains a liquid 103, an arming device or ball rotor assembly 104, and a body 105 which supports a firing pin 112. The wall of the cavity has one or more axial grooves 110. The cavity also contains a biasing spring 106 which acts on the body 105. The density of the fluid 103 is greater than that of the movable parts contained in the cavity.

The body 105 has an axially extending opening 117 at its forward end and within which is an annular detent flange 116. Rearwardly of the opening 117 is a primer charge 108 which is spaced from a delay pyrotechnic mix 109 that burns slowly for a period of time such as six seconds. The mix 109 adjoins an output charge 111 adjacent the firing pin 112.

The ball rotor assembly 104 has a bore 104*a* in which the firing pin 112 normally is accommodated and a diametrical bore at the opposite ends of which are detonator charges 114 and 114a. Between the charges is a firing pin 113.

At the forward end of the housing 100 and projecting into the cavity 101 is a barbed detent pin 107. The pin 107 is aligned with the opening 117 at the forward end of the body 105.

Upon experiencing a launching acceleration, liquid 103 rushes rearwardly of the fuze via the groove or grooves 110, thereby resulting in a net increase in the buoyant force acting on the body 105. The force of the biasing spring 106 is overcome and the body 105, together with the firing pin 112, moves forwardly toward the nose of the fuze. The fluid passage grooves 110 preferably have a sufficiently large cross-sectional area that the forward movement of the body 105 is quite rapid so as to enable the firing pin 107 to enter the opening 117 and detonate the primer 108. The primer in turn initiates the pyrotechnic delay mix 109 within the body 105 which burns slowly as the projectile travels through the atmosphere. During this time, the ball rotor assembly 104 will have rotated an amount such as to align its detonator 114 with the spin axis of the projectile. If the projectile fails to strike a target within the self-destruct time provided by the delay mix 109, the charge 111 is initiated by the delay mix 109 and propels the firing pin 112 into the detonator 114. The detonator 114 in turns propels the firing pin 113 into the detonator 114a which ignites the booster 115 and initiates the main projectile charge.

After being launched the body 105 is maintained adjacent the nose of the fuze by means of the flange 116 which grips the detent pin 107. If the projectile strikes a target prior to self-destructing, the nose of the fuze will collapse adjacent the forward end of the cavity 101, thereby forcing the firing pin 112 into the detonator 114 and initiating the round. If the target is a relatively thin target, a slight delay is achieved to permit greater penetration of the projectile into a target. Such delay is effected due to the requirement that the projectile round cannot be initiated until the detonator 114a is initiated. However, if the fuze strikes a rigid target, the nose of the fuze will crush sufficiently far to drive the firing pin directly into the detonator 114 so as to avoid the short delay referred to above.

A fuze similar to that shown in FIG. 5 could be used for non-spinning projectiles wherein an alternate arming delay timer is used in place of the ball rotor. The floating body 105 still could be used to initiate the arming delay by means of the body's forward motion or to accomplish self-destruction of the projectile.

The number and cross-sectional area of the passages are so selected as normally to permit rapid and easy flow of the liquid 103 around the body 105. In some cases, however, it may be desirable to restrict the cross-sectional area of such passages so as to provide for integration of the launching acceleration. In such case, the fuze is capable of differentiating between a high acceleration, short duration pulse, such as is experienced when the fuze is dropped, and a true launching acceleration.

As has been indicated earlier, an important characteristic of the invention is that the movable parts contained within the fuze of all of the described embodiments have an average specific gravity less than that of the liquid which occupies the cavity. The specific gravity of the liquid preferably is greater than 1. In the preferred embodiments, the body per se is composed of a plastic material, such as nylon, which has a specific gravity of about 1.15. Those parts carried by the body are of such size with respect to that of the body that, although the specific gravity of the combined body and its parts is greater than that of the body itself, the specific gravity of the combination is not materially greater than that of the body.

Suitable liquids are those containing bromine, and one such liquid is dibromomethane (methylene bromide) which has a specific gravity of approximately 2.50. There are, however, a variety of halocarbon fluids, such as those manufactured by the Halocarbon Corporation (New Jersey) and Dow Chemical Company (Midland, Mich.), which have a specific gravity high enough to be useful. Dibromomethane is slightly corrosive and, therefore, known corrosion inhibitors may be added to the fluid. Moreover, additives may be included to reduce the freezing point of the fluid. In addition, a small quantity of a boundary lubricant such as olic acid, has been found to be useful. All of these additives have the effect of reducing slightly the specific gravity of the basic liquid, but the reduction in specific gravity is not material. For example, a combination of dibromomethane, a corrosion inhibitor, a freezing point depressant, and a boundary lubricant has a specific gravity of about 2.45.

The disclosed embodiments are representative of presently preferred forms of the invention, but are intended to be illustrative rather than definitive thereof. The invention is defined in the claims.

What is claimed is:

1. A fuze adapted to be fitted to one end of a munitions projectile, said fuze comprising an elongate housing member having an elongate cavity therein between its forward and rearward ends, arming means mounted in said housing member rearward of said elongated cavity and in communication therewith, and being movable between safe and armed positions; said cavity and said housing member having elongate axes coinciding substantially with one another; a fluid contained in and substantially filling said cavity; a body member accommodated in said cavity for free sliding movements fore and aft of said cavity and immersed in said fluid, said fluid having a specific gravity greater than the average specific gravity of said body member whereby said body member is buoyant; resilient means acting on said body member and being of such capacity as to overcome the buoyancy of said body member and bias the latter to a position at the rearward end of said cavity; fluid passage means between said members enabling sufficient fluid flow aft of said cavity in response to forward acceleration of said housing member to overcome the bias of said resilient means and displace said body member forwardly of said cavity; and releasable locking means mounted on said body member acting on said arming means to maintain the latter in its safe position when said body member is in a position at the rearward end of said cavity and responsive to forward displacement of said body member to release said arming means whereby the latter is enabled to move to its armed position.

2. A fuze according to claim 1 wherein the fluid passage means is in said housing member.

3. A fuze according to claim 2 wherein said passage has a cross-sectional area such as to impede fluid flow therethrough.

4. A fuze according to claim 1 including detent means for latching said body member in one position in said cavity following forward movement of said body member.

5. A fuze according to claim 4 wherein said detent means comprises at least one element movable transversely of said cavity in response to changes in rotational velocity of said housing member.

6. A fuze according to claim 5 wherein said cavity has a recess in its wall and in which said element may seat.

7. A fuze according to claim 6 wherein said recess has a side wall inclined inwardly and toward one end of said housing member.

8. A fuze according to claim 4 wherein said detent means comprises a barbed pin.

9. A fuze according to claim 4 wherein said detent means comprises a flange.

10. A fuze according to claim 1 wherein said fluid has a specific gravity greater than 1.

11. A fuze according to claim 1 wherein said fluid is selected from the class of fluids containing bromine.

12. A fuze according to claim 1 wherein said fluid comprises a halocarbon.

13. A fuze according to claim 1 wherein said fluid comprises dibromomethane.

14. A fuze according to claim 1 including means responsive to forward movement of said body member to initiate an explosive charge.

15. A fuze according to claim 1 including means carried by said body member for initiating an explosive charge.

* * * * *